United States Patent [19]

Ponder

[11] Patent Number: 4,921,407

[45] Date of Patent: May 1, 1990

[54] PRODUCTION PUMP FOR HIGH GRAVITY OR SAND LADEN OIL

[76] Inventor: Mack Ponder, c/o Box 2229, Alice, Tex. 78333

[21] Appl. No.: 354,859

[22] Filed: May 22, 1989

[51] Int. Cl.[5] ..... F16K 21/10; F04B 47/12

[52] U.S. Cl. ..... 417/553; 417/554

[58] Field of Search ..... 417/552–554, 417/360, 448, 434, 449, 450, 545, 550, 551; 166/68, 105, 117.7, 237, 317, 331, 378, 380; 403/2, 11, 16, 348, 349

[56] References Cited

U.S. PATENT DOCUMENTS 2,327,503 8/1943 Coberly ..... 417/401

2,420,151 5/1947 Renouf et al. ..... 417/434

*Primary Examiner*—Leonard E. Smith

*Assistant Examiner*—John A. Savio, III

*Attorney, Agent, or Firm*—Gunn, Lee & Miller

[57] ABSTRACT

A plunger type pump for use with heavy oil or oil mixed with sand is set forth. It incorporates bottom and top cylinders which are joined at a central bushing. A standing check valve in a polished tube enlargement at the top end cooperates with a bottom check valve in the bottom cylinder. A safety joint on the sucker rod string is included for easy connection. Another feature is a top end sleeve connected with a pin and J-slot arrangement held to a surrounding sleeve. Two sleeves are separated by breaking shear pins axial movement, rotation in a particular direction and additional axial movement to accomplish J-slot disengagement.

10 Claims, 2 Drawing Sheets

FIG. 2
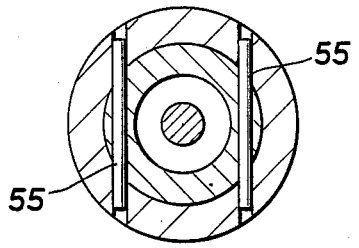
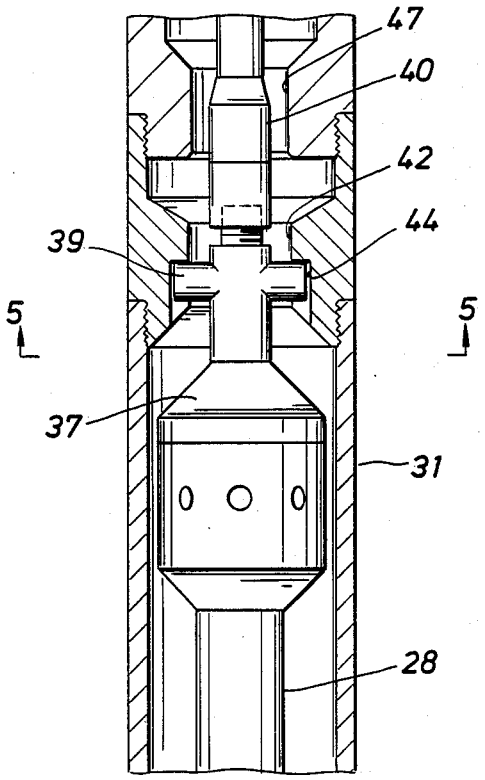
FIG. 4
FIG. 3
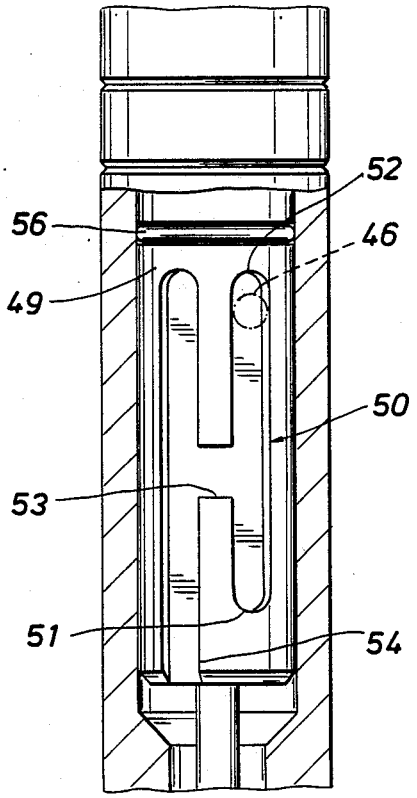
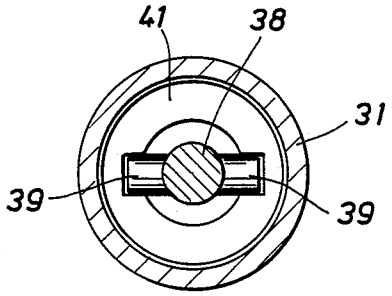
FIG. 5

PRODUCTION PUMP FOR HIGH GRAVITY OR SAND LADEN OIL

BACKGROUND OF THE DISCLOSURE

The present disclosure is directed to a plunger type pump to be set in a well which produces high gravity oil, or alternatively oil which is laden with substantial quantities of sand. In circumstances of this sort, it is necessary to periodically pull the pump on the production string so that servicing can be implemented, one example being the washing of sand from the lower parts of the well. In another instance, it may be necessary to disconnect and later reconnect the plunger type pump for restarting production.

After a well has been completed and casing has been set, perforations are normally made into a formation of interest where the oil produces into the well. It typically produces in a zone above a bridge plug or other bottom packer, and a pump supported packer is installed near the production zone. A plunger type pump is normally installed on or connected with the packer which supports the pump. This permits the pump to be anchored or stationary in the cased hole. The pump is then connected with a production tubing string extending thereabove, and a string of sucker rods is connected through the production tubing to reciprocate the pump.

It is not uncommon to encounter an oil producing formation which yields a high gravity oil. It typically will have tar like consistency and is somewhat difficult to produce. Another factor which changes the handling of the oil is production of sand in the oil. Excessive sand can materially alter flow characteristics of the oil. In either case, the produced oil is difficult to handle because it is so viscous. Even at greater depths, depth sufficient to expose the oil to increased temperatures, the temperature is not necessarily high enough to convert the tacky fluid into a more viscous fluid. Even where some change in viscosity does occur, sand particles may settle out from the standing column of oil in the production tubing and clog the regions around the pump. As the sand collects in the pump, it is necessary to periodically disassemble the pump and clean out the sand particles.

The present apparatus is an improved, easily removed, plunger type pump which can be removed quite readily on the tubing string. It is constructed with an elongate pump cylinder which terminates at a valve body and that in turn is threaded on the exterior or tapered to enable stabbing into the supportive hold down or packer on which the pump apparatus is supported. A lower check valve is included in this assembly, and opens into the pump cylinder. The pump cylinder encloses the double acting plug supported on the polished tube for reciprocation. The polished tube passes through a double acting packoff bushing, and extends upwardly thereabove to an upper check valve assembly. The polished tube is hollow so that production oil which is admitted from the lower check valve is periodically forced into the polished tube and is raised in the polished tube. As the stroke is made, the polished tube will move downwardly, forcing production oil up through the polished tube and out through the upper check valve at the top end of the polished tube. This forces the production oil above the packoff bushing. In that region, it then forms a standing column of oil extending up through the pump cylinder top section, an appropriate set of breakout bushings, and then into a connective sub. This sub is threaded to the equipment just described and, at the top end, it joins to a J-slot pin mechanism which is adapted for joinder to the lower end of the production tubing. In addition, the upper check valve has a fitting at the top end which threads to a sucker rod breakout lug mechanism and then to a string of sucker rods. The breakout lugs match breakout slots thereabove on a bushing so that the sucker rod string can be pulled upwardly, positioning the breakout lugs in the bushing slots permitting disengagement of the sucker rod string at the bottom most threaded joint. This unthreading sequence is accomplished by threading, a direction which would otherwise tighten all threaded joints in the sucker rod string. J-slots are included in the topmost sub. The production tubing string and the top sub are joined by a sized shear pin which permits an upward pull to make disconnection. When the upward pull occurs, the tubing string is pulled upwardly by a short distance to initiate operation of the pin and J-slot mechanism. This assures complete disconnection of the tubing string. Complete disconnection of the sucker rod string is accomplished in the manner mentioned so that the entire plunger type pump mechanism is completely disconnected.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a sectional view along the line 2—2 of FIG. 1A showing location of the shear pins which hold the components together;

FIG. 3 is a sectional view through the upper end of the tool shown at FIG. 1A and further showing the position of a pin traveling in a J-slot, the pin and J-slot providing a controlled releaseable connection between the tubing string thereabove and the pump of the present disclosure;

FIG. 4 is a sectional view through the pump showing details of the construction of an upper standing valve at the top end of the polished tube and further showing protruding backup lugs extending from a sucker rod fitting to enable connection of the sucker rod string and unthreading for service; and FIG. 5 is a view along the line of 5—5 in FIG. 4 showing how the backup lugs are locked into position for rotation in the opposite direction for unthreading.

DETAILED DESCRIPTION OF THE PREFERRED EMBODIMENT

Figure 1A:
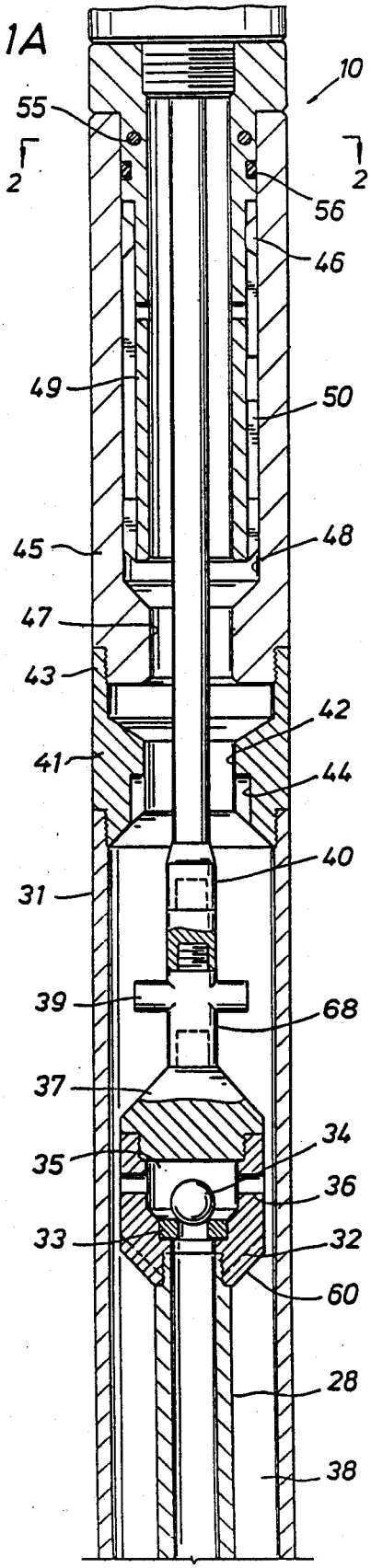
FIGS. 1A and 1B jointly are a sectional view through the elongate tool of the present disclosure showing a lower check valve for supporting a column of oil thereon, a polished tube with surrounding bushing and a tube supported upper standing valve which causes lifting action of the oil so that oil is produced through the production tubing powered by reciprocation of a string of sucker rods which are releaseably connected to the top of to the polished tube.
Figure 1B:
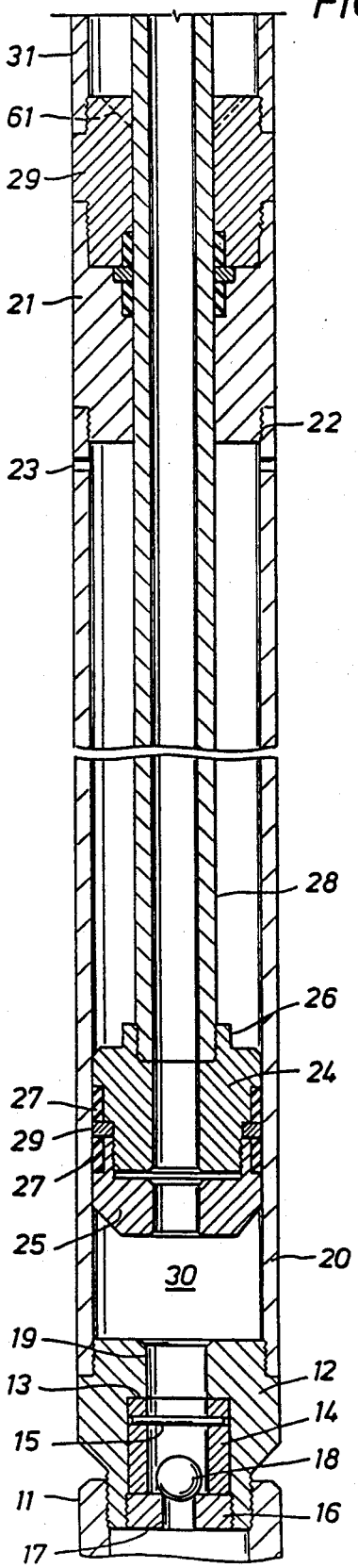

Attention is jointly directed to FIGS. 1A and 1B which show the plunger type pump of the present disclosure and which is identified by the numeral 10. It is normally installed in a cased well which has been perforated into a producing formation. It is normally supported on a hold down or packer, one such apparatus being identified at 11 at the lower end of FIG. 1B. It is supported in that region so that it can be submerged in production fluid. This pump is particularly useful with heavy oil or oil that is loaded with grit and the like. The description will proceed from the bottom and assumes that the device is installed in the cased producing well for pumping heavy oil.

The lower end of the structure incorporates a tapered plug 12 having an internal shoulder 13 which supports a sleeve 14. The sleeve is removable so that it can be replaced for easy installation of a transverse locking pin 15. The pin 15 is incorporated to prevent escape of a valve element. The sleeve 14 is easily removed and reinserted with the pin in place. The tapered lower end of the plug 12 receives a ring 16 which is threaded in place, having an axial passage 17 therethrough. The passage 17 is an inlet passage which opens into the interior of the plunger type pump. The tool is installed and operated in a standing column of produced oil around the tool which is forced by pressure differential into the tool so that the inward flow lifts a check valve ball 18 off the ring 16 which functions as a valve seat. This introduces upward flow into the passage 19.

The plug 12 threads to an outer bottom cylinder 20 constructed in the form of an upstanding sleeve which threads to the plug. It extends upwardly to a packoff bushing 21 which is constructed as a tubular sleeve, the members 20 and 21 threading together at 22. Relief ports 23 are included to avoid trapping fluid within the cylinder and creating unwanted back pressure.

A reciprocating piston 24 is located in the cylinder and travels upwardly and downwardly. It is constructed of multiple components having a lower tapered plug 25 and an upper joined plug portion 26. The piston 24 is formed by threading the two components together. They trap therebetween an encircling seal ring 29 which captures packing members 27. This prevents leakage around the piston 24. The piston is hollow, and threads to an upstanding polished tube 28. The tube 28 extends thereabove to deliver flow into the tubing string as will be described. The polished tube 28 is a threaded to the piston 24. This arrangement of the piston in conjunction with the upstanding polished tube defines a chamber 30 below the piston which is filled with produced oil moving past the check valve element 18. The oil fills the chamber 30 and flows upwardly through the polished tube when the piston 24 is forced downwardly. On the upstroke, the piston 24 creates a partial vacuum, thereby causing the chamber 30 to be filled with produced oil.

Proceeding up FIG. 1B, it will be observed that the cylinder 20 threads to the bushing in the form of a hollow sub at 21, and that in turn threads to another threaded sub 29 thereabove. They capture appropriate seals for preventing leakage along the polished tube 28. The sub 29 supports a top cylinder 31 which also extends substantially along the length of FIG. 1A. The polished tube 28 also extends upwardly in the top cylinder 31 and terminates at a valve housing 32. The valve housing has the form of an enlargement which is internally hollow. As shown in the sectional view, it is constructed with an internal seat member 33 which supports a spherical valve element 34 which is captured within a chamber 35. The chamber is relieved to the exterior by a number of radial passages 36. The passages are provided with one way flow because the valve element 34 operates as a check valve. The upward flow is thus through the polished tube 28 and out of the enlargement 32. This flow is introduced into the chamber 38. The chamber 38 is located above the bushing members 21 and 29. The chamber 38 is located within the top cylinder 31. Produced oil is accumulated in the chamber 38 and indeed, the production forms a standing column which extends from the bushing 29 to the wellhead.

The enlargement 32 is threaded to a tapered sub 37 and supports an upstanding lug equipped connector 68. It has the protruding lugs 39 shown thereon. In turn, the connector threads to the bottom most sucker rod of the string which is the sucker rod safety joint 40 shown in FIG. 1A. In turn, that connects with the string of sucker rods extending to the surface where the pump is actuated by a typical power source. The top cylinder 31 joins to a sub 41 which has an axially hollow passage 42 sized to receive the sucker rod safety joint 40 therethrough with clearance. The sub 41 has a upstanding threaded skirt 43 for connection with the next component as will be described. In addition, it has a pair of internal notches 44 to receive the lugs 39. These notches are located so that upward pull on the sucker rod string locates the lugs 39 in the mating receptacles so that the sucker rod string can be unthreaded by disconnecting at the safety joint 40.

The sub 41 threads with a safety sleeve 45. The sleeve 45 again is axially hollow. The sleeve 45 supports an internally protruding pair of lugs 46. They are located opposite one another to engage diametrically opposing J-slots as will be described. The sleeve 45 is provided with an axial passage 47 which is more than adequate in diameter for the sucker rod to pass through, and which passage is enlarged to a greater diameter at 48 to receive a sleeve 49 therein. The concentric sleeve 49 is constructed with a J-slot 50 where, the path of the J-slot is better shown in FIG. 3. Going there for the moment, the J-slot 50 has several segments worth noting. When the sleeve 49 is pulled upwardly, downward travel of the engaging pin or lug 46 is limited at the dead end 51 in the slot. Travel to the full extremity permitted at the opposite direction carries the pin to the end 52. Disengagement is accomplished on partial rotation of the sleeve 49, causing the pin 46 to pass through the horizontal segment 53. Once the pin has moved to the left as viewed in FIG. 3, It can then pull completely free by traversing the slot 54 and escaping. When this occurs, the sleeve 49 is completely free of the surrounding sleeve 45.

The movement described above is not ordinarily permitted. The two sleeves are joined together by suitable shear pins 55 also shown in FIG. 2. The two sleeves are joined together with a seal ring 56 therebetween. A jarring upward pull breaks the pins 55 and frees the two sleeves for telescoping movement as will be described.

OPERATION OF THE PRESENT APPARATUS

The present apparatus in its use and installation will be described. Assume first that a well has been completed, casing has been set, perforations have been made into a producing formation, and production fluid has accumulated in some measure in the casing. Assume further that there is a bridge plug or the like below the perforations and a standing column of produced oil is above the bridge plug and also assume that the packer or hold down mechanism in the casing is located so that the plunger pump 10 can be installed thereon. Accordingly, the pump 10 is threaded to a tubing string, run into the cased well, and is threaded into the supporting packer or other hold down, and is thereby anchored in position. It is not yet ready to operate until after installation of the sucker rod string. Briefly, that is accomplished by running the sucker rod string into the supporting casing until the sucker rod safety joint 40 lands at the illustrated position in FIG. 1A. By appropriate rotation, the threaded connection is completed.

It is necessary to thread the sucker rod safety joint 40 snugly and tightly. This is accomplished by permitting the enlargement 32 to travel to the bottom extremity of movement. When this occurs, the enlargement abuts the bushing 29. The enlargement is constructed with spline ribs 60 around the bottom face, and these ribs engage the splines 61 which are formed at the top of the bushing 29. The mating spline members mate to permit engagement so that the two members cannot rotate. When the sucker rod string forces the enlargement 32 downwardly, this assures that the enlargement cannot rotate, is locked, and the backup accomplished through the spline connection assures full threading.

PUMPING OPERATION

Pumping is provided by reciprocating the sucker rod string. Assume that the polished tube 28 is in the downward position as shown in the drawings. In that event, an upward stroke raises the piston and also the polished tube. This creates a vacuum which reduces the pressure in the chamber 30. The external standing head of produced oil forces oil through the valve element 18 to partially, perhaps even totally, fill the chamber 30. The upstroke moves the piston to the extremity of travel while the chamber 30 is substantially filled with oil. On the downstroke, oil is forced upwardly into the polished tube 28. No oil can escape because the valve element 18 functions as a check valve. On the downstroke, oil in the polished tube 28 is ultimately forced upwardly past the valve 34 which again operates as a check valve. On each downstroke, a certain portion of oil is forced through the valve element 34 and fills the top chamber 38. Oil received into this chamber accumulates as a standing column. With each stroke, the oil stands taller until the entire tubing string is filled above the valve 34 and the bushing 29. With each stroke, the vacuum that is pulled in the chamber 30 is relieved by forcing oil from the casing into the chamber 30.

SERVICE AND REMOVAL

Assume that the present apparatus requires removal or servicing. Further assume that it will be carried out in the ordinary fashion. One of the service steps is the unthreading the sucker rod string. Every joint in the sucker rod string is threaded together by threading in the conventional hand. The sucker rod safety joint 40 unthreads by rotating in that direction. Recall that it was firmly threaded heretofore at the time of installation. For unthreading, the sucker rod string is raised until the protruding lugs 39 position in the notches 44, see especially FIG. 5. With the lugs locked in position, threading in the direction which normally tightens every threaded connection in the sucker rod string will unthread the safety joint 40 so that disconnection can then be accomplished. This permits retrieval of the sucker rod string. As desired, the sucker rods can be reinstalled by forcing the splines 60 and 61 together.

One important aspect of the present apparatus is the ability to disconnect the tubing string from the pump 10. A jarring action is applied to break the shear pins 55. The sleeve 49 pulls free of the surrounding sleeve 45. Upward travel however does not fully accomplish disengagement. Rather, movement relocates the locking pin 46 between the slot ends 51 and 52. The tubing string is manipulated to align the pin 46 at the horizontal pathway 53 shown in FIG. 3. Further rotation positions the pin so that it is to the left of the slot pattern shown in FIG. 3. In that location, a simple upward pull will disconnect the sleeve 49 as the pin slides neatly and easily out of the end of the slot 54. This accomplishes disengagement.

The various operations mentioned above for connecting and disconnecting are particularly important for servicing of the equipment. Since it is difficult to accomplish servicing in the best of conditions, it is sometimes very important to disconnect either the production tubing string, the sucker rod string or even both during servicing. For instance, if oil filled with sand is produced, the sand may accumulate in the top cylinder chamber 38. This may bind the travel of the polished tube and the enlargement affixed to the end of it. In any event, it may be necessary to periodically disconnect so that the accumulated sand oil can be washed out and later oil production is enhanced. Another important feature is the privilege of reconnecting the sucker rod string and having the assurance of a fully made up threaded connection at the safety joint 40. The upward pull prior to unthreading assures that the enlargement is held with a backup, thereby permitting easy disconnection. On the downward stroke, the enlargement engages the bushing therebelow with splines which prevent rotation so that the threaded connection can be made snug.

One of the virtues of the present apparatus is that it takes advantage of the conventional mode in which tubing strings and sucker rod strings are assembled. The tubing string is assembled by threading the components together where the threading occurs in a conventional direction. The motion required to disconnect the tubing string from the pump of the present disclosure does not run the risk of unthreading by rotation in the opposite direction. Rather, it requires a jarring motion to shear the sacrificial pins, and then simple maneuvers to operate the J-slot mechanism for disconnection. This avoids the risk of unthreading the tubing string. The same is true with regard to the sucker rod string. Again, it is threaded together by threading the sucker rods into the string on rotation in a conventional direction, and thus the rod string is assembled. The sucker rods are thus connected to the pump by permitting the reciprocating part of the pump to move to the bottom or downstroke location where it is locked against subsequent rotation by spline engagement. At this juncture, the sucker rod string is threaded into the pump to make the operative connection required. This threaded connection completes the installation of the sucker rod string in the well to operate the reciprocating pump. The sucker rod string is thus pulled upwardly, disengaging the splines and permitting reciprocation. Rotation of the reciprocating part may occur because it is then free to rotate.

Disconnection of the sucker rod string involves upward pulling, then holding the reciprocating part against rotation momentarily while the sucker rod string is rotated in the hand opposite that required for assembly of the sucker rod string. This rotation will tighten every joint in the sucker rod string and will untighten the sucker rod string from the reciprocating pump, permitting the string to pull loose from the pump.

While the foregoing is directed to the preferred embodiment the scope thereof is determined by the claims which follow.

What is claimed is:

1. A plunger type reciprocating pump for a producing oil well comprising:

(a) an elongate pump housing having an open upper end and a reciprocating part therein;

(b) tubing connector means for said open upper end for connection to a production tubing string assembled by threading together tubing joints to produce oil into the string and wherein said connector means includes;

(i) means telescoping relative to said tubing string to form an oil flow path therewith;

(ii) fastening means operative to secure said tubing string and said pump housing at the open upper end thereof, said fastening means releasing said tubing string on relative motion other than threading motion involved in threading together said tubing string;

(iii) first and second telescoping concentric sleeves and sacrificial shear means joining said sleeves to prevent telescoping movement; and (c) sucker rod connector means connecting a sucker rod string assembled of sucker rods threaded together by threading in a conventional direction, said connector means comprising:

(i) first means selectively holding said reciprocating part against rotation to enable threading said sucker rod string to said reciprocating part; and (ii) second means selectively holding said reciprocating part against rotation to enable unthreading of said sucker rod string by rotation opposite the conventional direction.

2. The apparatus of claim 1 wherein said shear means also prevents relative rotation between said concentric sleeves.

3. The apparatus of claim 1 further including a resilient seal means operatively deployed between said first and second telescoping sleeves to prevent fluid flow therebetween.

4. The apparatus of claim 1 wherein said fastening means incorporates first and second sleeves and aid sleeves connect together by J-slot means on one of said sleeves and a cooperating pin on the other of said sleeves is engaged with said J-slot means, and said J-slot means guides said pin out of engagement therewith on movement of said pin along said J-slot means and wherein said J-slot means includes an exit for said pin for disconnection by said fastening means.

5. A plunger type reciprocating pump for a producing oil well comprising:

(a) an elongate pump housing having an open upper end and a reciprocating part therein;

(b) tubing connector means for said open upper end for connection to a production tubing string assembled by threading together tubing joints to produce oil into the string and wherein said connector means includes;

(i) means telescoping relative to said tubing string to form an oil flow path therewith;

(ii) fastening means operative to secure said tubing string and said pump housing at the open upper end thereof, said fastening means releasing said tubing string on relative motion other than threading motion involved in threading together said tubing string;

(iii) wherein said fastening means comprises first and second sleeves wherein said sleeves are joined together by duplicate J-slot means operating with duplicate pins inserted thereinto and said duplicate J-slots means are deployed 180° apart on said sleeves, and said sleeves are joined by telescoping at the upper end of said elongate pump housing, and said elongate pump housing includes means located near the lower portions thereof to enable anchoring in a cased oil well;

(iv) wherein one of said sleeves connects to the tubing string and the other of said sleeves connects to said pump housing; and (v) said fastening means including shear pin means joining said sleeves together; and (c) sucker rod connector means connecting a sucker rod string assembled of sucker rods threaded together by threading in a conventional direction, said connector means comprising:

(i) first means selectively holding said reciprocating part against rotation to enable threading said sucker rod string to said reciprocating part; and (ii) second means selectively holding said reciprocating part against rotation to enable unthreading of said sucker rod string by rotation opposite the conventional direction.

6. A plunger type reciprocating pump for a producing oil well comprising:

(a) an elongate pump housing having an open upper end and a reciprocating part therein;

(b) tubing connector means for said open upper end for connection to a production tubing string assembled by threading together tubing joints to produce oil into the string and wherein said connector means includes;

(i) means telescoping relative to said tubing string to form an oil flow path therewith; and (ii) fastening means operative to secure said tubing string and said pump housing at the open upper end thereof, said fastening means releasing said tubing string on relative motion other than threading motion involved in threading together said tubing string;

(c) sucker rod connector means connecting a sucker rod string assembled of sucker rods threaded together by threading in a conventional direction, said connector means comprising:

(i) first means selectively holding said reciprocating part against rotation to enable threading said sucker rod string to said reciprocating part and wherein said first means comprises first and second mating spline members, and one of said spline members is fixed relative to said reciprocating part, and the mating spline member is relatively fixed to said elongate pump housing; and (ii) second means selectively holding said reciprocating part against rotation to enable unthreading of said sucker rod string by rotation opposite the conventional direction.

7. The apparatus of claim 1 wherein said first and second spline members are engaged by moving said reciprocating part downwardly to the farthest extend of motion permitted therefor.

8. The apparatus of claim 7 wherein said second means comprises an internal cavity within said elongate pump housing having a lug receiving portion therein, and wherein said cavity is above said reciprocating part, and further wherein said reciprocating part supports a protruding lug which fits within said cavity to lock said reciprocating part against rotation on upward travel of said reciprocating part to the limit of motion therefor.

9. The apparatus of claim 8 wherein said reciprocating part is located below the open upper end of said elongate pump housing, and reciprocates within said housing between upper and lower positions, and said sucker rod string extends through first and second telescoping sleeves comprising said tubing connector means, and said tubing connector means is relatively fixed to said elongate pump housing on connection with said tubing string and permits relative movement on disconnection of said tubing string from said elongate pump housing.

10. The apparatus of claim 6 wherein (a) said tubing connector means is pin connected prior to use by a shear pin to obtain locking of the production tubing string;

(b) said sucker rod connector means threads to the sucker rod string;

(c) said pump housing includes the open upper end aligned with and joined by a seal means to the production tubing string; and further including (d) an upper check valve for a standing column of fluid in the production tubing string.

* * * * *